US005190484A

United States Patent [19]

Kennedy

[11] Patent Number: 5,190,484

[45] Date of Patent: Mar. 2, 1993

[54] CLAMP FOR A BATTERY CABLE

[76] Inventor: Juan Kennedy, 2245 SW. 31 Ave., Miami, Fla. 33145

[21] Appl. No.: 929,531

[22] Filed: Aug. 14, 1992

[51] Int. Cl.[5] ..... H01R 4/28

[52] U.S. Cl. ..... 439/761; 439/371; 439/765

[58] Field of Search ..... 439/371, 483, 484, 761, 439/762, 764, 765, 808

[56] References Cited

U.S. PATENT DOCUMENTS

| | | | |
|---|---|---|---|
| 2,878,460 | 3/1959 | Coleman | 439/761 |
| 2,894,244 | 7/1959 | Ringhof | 439/761 |
| 3,488,627 | 1/1970 | Martinez | 439/761 |
| 4,099,827 | 7/1978 | Webster | 439/761 |
| 5,030,106 | 7/1991 | Cameron et al. | 439/765 |

*Primary Examiner*—Paula A. Bradley
*Attorney, Agent, or Firm*—Malloy, Downey & Malloy

[57] ABSTRACT

A clamp for a battery cable, to be easily secured and removed from a battery terminal stud, the clamp including a main clamp body having a vertical bore extending therethrough which is adapted to receive the battery terminal stud therein, the clamp body further including a vertical channel extending from the vertical bore to a distal face of the clamp such that when confronting faces of the vertical channel are pushed towards one another, the vertical bore is tightened about the terminal stud so as to secure the clamp thereto. The inner faces of the vertical channel are pushed towards one another by a strong, yet flexible track which is attached at its distal end to one of the inner faces of the vertical channel and extends through an axial channel to engage a tightening member rotatably mounted within the clamp body such that when the tightening member is rotated from an exteriorly engageable head portion thereof, the track is correspondingly moved to cause either the tightening of the vertical bore about the terminal stud or the loosening of the vertical bore to allow removal.

11 Claims, 2 Drawing Sheets

CLAMP FOR A BATTERY CABLE

BACKGROUND OF THE INVENTION

1. Field of the Invention

The present invention relates to a clamp for a battery cable which can be easily tightened or released about a terminal stud utilizing only a single, common tool, thereby providing a user with an effective and manageable means of attaching a battery cable to a battery terminal stud such as those on an automobile battery.

2. Description of the Related Art

When utilizing an automobile or like battery, the battery cable which provides the power to the vehicle or mechanism must be securely clamped in current flow communication with the terminal studs of the battery. This connection must necessarily be secure to prevent dislodging of the connection during use of the vehicle or mechanism, which could result in a short circuit or injury. Traditionally, battery cable clamps include nut and bolt-type tightening assemblies which require multiple tools to loosen and tighten and are often difficult to access for the tightening or loosening necessary. Accordingly, it would be highly beneficial to provide a clamp for a battery cable which while providing a secure and tight fit during use, can also be easily loosened when so required.

The device of the present invention is designed precisely to be tightened or loosened utilizing a single tool such as a screwdriver, and be easily accessible for tightening and loosening. Additionally, the battery cable may be permanently or removably connected to the clamp such that the clamp may be replaced if necessary.

SUMMARY OF THE INVENTION

The present invention is directed towards a clamp for a battery cable adapted to be quickly and easily tightened and loosened from a secure position about a battery terminal stud on a car or like battery. The clamp includes primarily a main clamp body having a top face, a bottom face, a distal clamping portion, and a proximal cable connection portion. Included within the distal clamp portion is a vertical bore which extends on the top face through to the bottom face so as to receive the battery terminal stud therein. Extending from the vertical bore to a distal face of the clamp body is a vertical channel. This vertical channel extends from the top face through the bottom face and is adapted such that by compressing a first inner face and a second inner face of the vertical channel, which are disposed in spaced, confronting relation to one another, a gap between the confronting faces will be reduced and the dimensions of the vertical bore will be reduced such that the clamp is securely tightened about the terminal stud. Tightening means are included to pull the second inner face of the vertical channel towards the first inner face of the vertical channel during tightening about the terminal stud. These tightening means include a rotatable sprocket mounted within the clamp body. This sprocket is completely within the distal clamping portion of the clamp body with the exception of an upper, exteriorly engageable head portion which is accessible through the top face of the clamp body. This head portion is adapted to facilitate the clockwise or counter-clockwise rotation of the internally mounted sprocket during tightening and loosening of the clamp. Extending at least from the sprocket through the first and second inner faces of the vertical channel is an axial channel. The axial channel is disposed to allow the passage therethrough of a strong, yet flexible track having a proximal end, a distal end, and a plurality of engagement apertures disposed along a length thereof. The distal end of the track is secured to the clamp body near the second inner face of the vertical channel such that pulling or releasing the track will result in corresponding movement of the second inner face towards or away from the first inner face of the vertical channel, thereby tightening or loosening the clamp about the terminal stud. Disposed about the periphery of the sprocket are a plurality of radially extending teeth, which extend into the axial channel. The teeth are structured and disposed to engage the apertures within the track thereby causing the movement o the track in accordance with the movement of the teeth. Included in the proximal portion of the clamp body is a longitudinal bore adapted to receive therein the battery cable. The battery cable may be permanently or removably secured within the longitudinal bore by fastening means which maintain a secure connection between the battery cable and the clamp body.

It is an object of the present invention to provide a clamp for a battery cable which requires only a single tool for facilitated tightening and loosening of the clamp about a terminal stud of a battery.

Still another object of the present invention is to provide a clamp for a battery cable whose tightening means are easily accessible, thereby further facilitating the securing or removing of the clamp about a terminal stud of a battery.

A further object of the present invention is to provide a clamp for a battery cable which is securely connected to the battery cable, yet enables the removability of the battery cable if the clamp must be replaced.

BRIEF DESCRIPTION OF THE DRAWINGS

For a fuller understanding of the nature of the present invention, reference should be had to the following detailed description taken in combination with the accompanying drawings in which.

Like reference numerals refer to like parts throughout the several views of the drawings.

DETAILED DESCRIPTION OF THE PREFERRED EMBODIMENT

Figure 1:
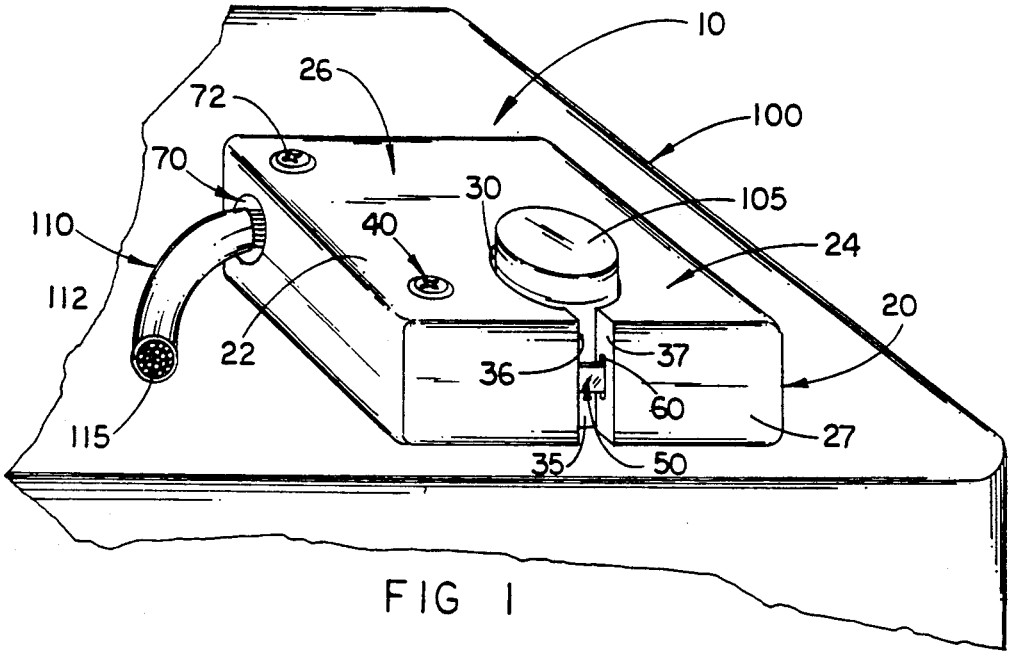
FIG. 1 is a perspective view of the clamp of the present invention.

Shown throughout FIGS. 1–7, the present invention is directed towards a clamp, generally indicated as 10, for a battery cable 110. Shown in FIG. 1, the clamp 10 is adapted to be secured about a terminal stud 105 of a battery 100 such that the battery cable 110 inner conductive coils 115 are in current flow communication with the terminal stud 105.

Figure 2:
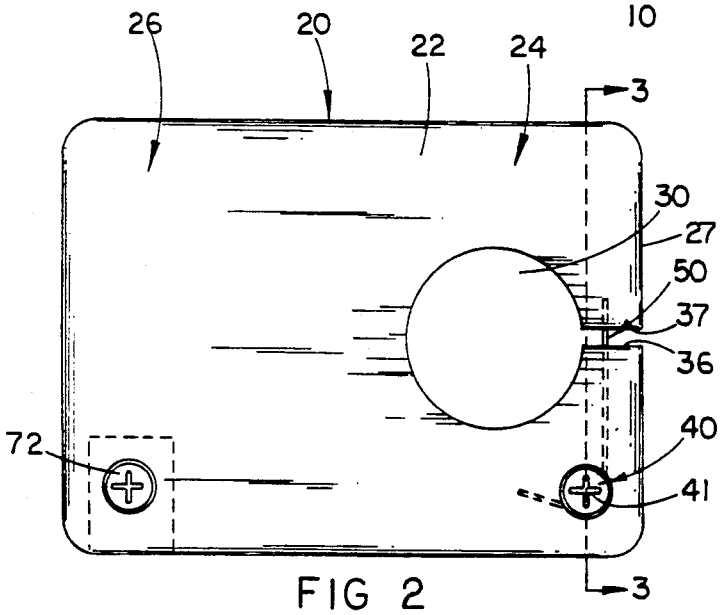
FIG. 2 is a top, plan view of the clamp of the present invention.

Referring to FIGS. 1 and 2, the clamp 10 primarily includes a main clamp body 20 having a top face 22 and a bottom face 21, and being divided into a distal clamping portion 24 and a proximal cable connection portion 26. Disposed in the distal clamping portion 24 and extending from the top surface 22 to the bottom surface 21 of the clamp body 20 is a vertical bore 30. The vertical bore 30 is sized to receive the battery terminal stud 105 therein for subsequent, secure tightening about the terminal stud 105. Extending from the vertical bore 30 to a distal face 27 of the clamp body 20 is a vertical channel 35. The vertical channel 35 extends from the top surface 22 through the bottom surface 21 of the clamp body 20 and includes a first inner face 36 and a second inner face 37 disposed in generally spaced confronting relation to one another so as to form a variable gap therebetween. In order to tighten the clamp 20 about the terminal stud 105, the confronting faces 36 and 37 are compressed towards one another by tightening means, resulting in the dimensions of the vertical bore 30 being lessened and accordingly tightened about the terminal stud 105.

Figure 3:
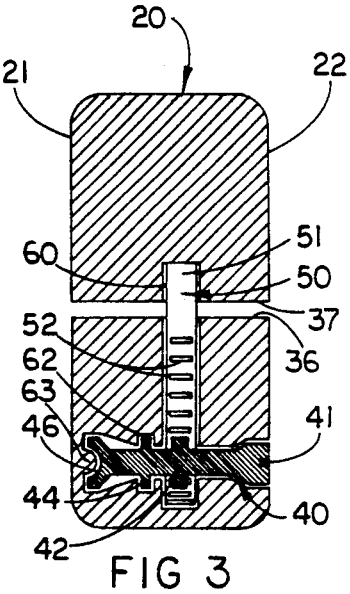
FIG. 3 is a cross-sectional view of the clamp of the present invention along line 3—3 of FIG. 2.

As shown in FIG. 3, the tightening means include a tightening member, which in the first embodiment is a rotatable sprocket 40 mounted within the clamp body 20. The sprocket 40 is contained completely within the clamp body 20 except for an upper, exteriorly engageable head portion 41 which is accessible through the top face 22 of the clamp body 20. Disposed within the clamp body 20 and extending at least from the sprocket 40 through the confronting faces 36 and 37 is a axial channel 60. Disposed within the axial channel 60 is a strong, yet flexible track 50 which effectuates the compressing of the confronting faces 36 and 37 towards one another. The track 50 is secured at a distal end 51 to the clamp body 20 at a point near the second inner face 37. Accordingly, when the track 50 is pulled towards the sprocket 40, the second inner face 37 is accordingly pulled toward the first inner face 36 resulting in the tightening of the clamp 10 about the terminal stud 105. Further, when the track 50 is released, the second inner face 37 is allowed to return to its normally spaced position from the first inner face 36, thereby resulting in the loosening of the clamp 10 about the terminal stud 105. The tightening and loosening resulting from the movement of the track 50 is achieved by a plurality of radially extending teeth 42 which protrude from the periphery of the sprocket 40. The teeth 42 are adapted to engage a plurality of apertures 52 disposed along a length of the track 50, thereby causing the track to move in accordance with the clockwise or counter-clockwise rotation of the sprocket 40. In order to maintain the sprocket 40 turning smoothly and properly oriented, the sprocket 40 includes a stabilizing rim 44 protruding from a periphery thereof. The stabilizing rim 44 is adapted to be rotatable within a sized recess 62 of the clamp body 20, thereby assuring that the sprocket 40 does not wobble or become misoriented. Also, the sprocket 40 includes a pivot recess 46 at a proximal end thereof, the pivot recess 46 being adapted to overlie a bearing protrusion 63 such that the sprocket 40 will rotate about the bearing protrusion 63 in a smooth, constant orientation.

Figure 4:
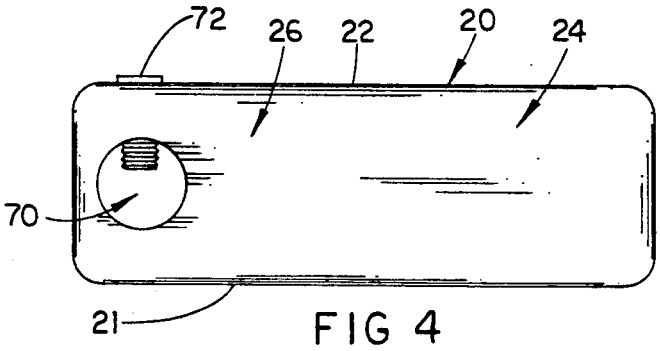
FIG. 4 is a side view of the clamp of the present invention.

Turning to FIG. 4, the clamp body 20 includes a longitudinal bore 70 in the proximal cable connection portion 26 of the clamp body 20. The longitudinal bore 70 is sized to receive the battery cable 110 therein, and includes fastening means to secure the battery cable within the longitudinal bore 70. The battery cable 110 may be either permanently or removably secured within the longitudinal bore 70. In the preferred embodiment, the fastening means includes a set screw 72 adapted to be screwed down upon the battery cable 110 resulting in the removable, secure tightening of the battery cable 110 within the longitudinal bore 70. More specifically, the longitudinal bore 70 is adapted to receive the inner conductive core portion 115 of the battery cable 110, which extends from a sleeve 112 of the battery cable 110, in electrical flow communication. As a result, the clamp body 20 is necessarily made of an electrically conductive material such as lead, in the preferred embodiment.

The sprocket 40 or adjustment screw 40' and the screw 72 are adapted to be easily rotated using only a single tool, and may be configured to receive a flat head screwdriver, a Phillips head screwdriver, or a socket head. The specific structure recited herein is the preferred embodiment of the present invention at the time of invention, and variations consistent with the intent claimed and the doctrine of equivalents should also be included.

Figure 5:
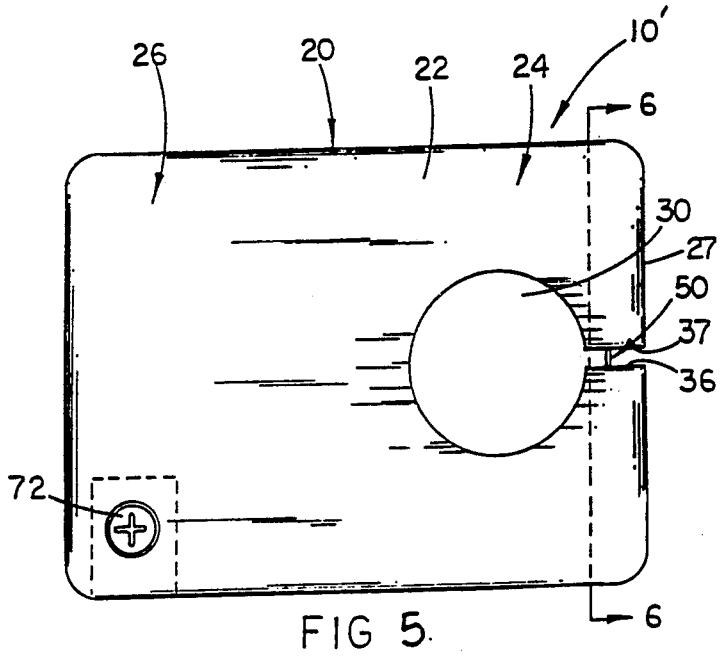
FIG. 5 is a top, plan view of a second embodiment of the clamp of the present invention.
Figure 6:
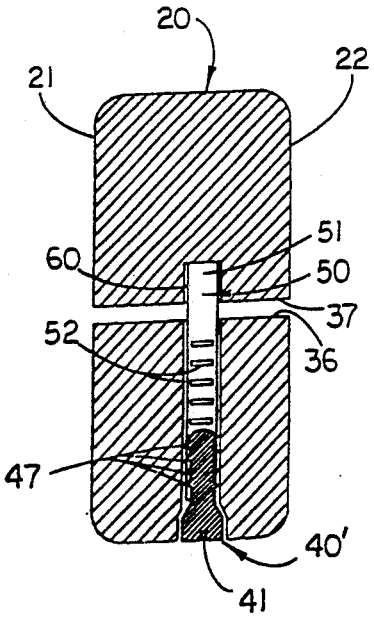
FIG. 6 is a cross-section view of the second embodiment of the clamp of the present invention along line 6—6 of FIG. 5.
Figure 7:
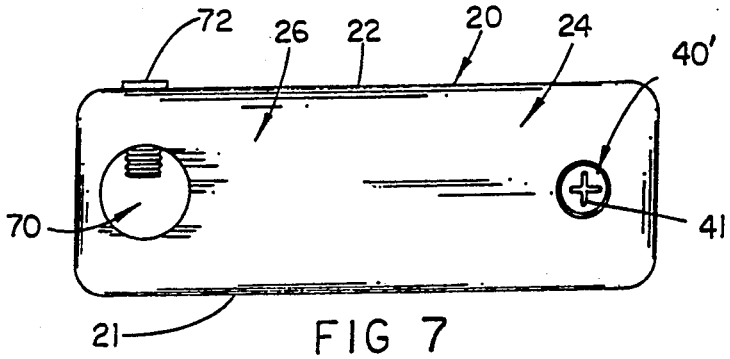
FIG. 7 is a side view of the second embodiment of the clamp of the present invention.

Shown in FIGS. 5, 6, and 7, a second embodiment of the clamp 10' includes alternative tightening means which utilize an adjustment screw 40' as the tightening member. The adjustment screw 40' is longitudinally positioned within the axial channel 60 and is adjusted by means of its exteriorly engageable head portion 41. The adjustment screw 40' is disposed such that its threaded exterior 47 engages the apertures 52 in the track 50, causing the track 50 to move in accordance with the clockwise, or counter-clockwise rotation of the adjustment screw 40'.

Now that the invention has been described,

What is claimed is:

1. A clamp for a battery cable comprising:

a main clamp body, said clamp body including a top face, a bottom face, a distal clamping portion, and a proximal cable connection portion, said distal clamp portion including a vertical bore extending therethrough between said top face and said bottom face, said vertical bore being adapted to receive a battery terminal stud therein, a vertical channel extending from said vertical bore to a distal face of said clamp body, and from said top face to said bottom face of said clamp body, said vertical channel including a first inner face and a second inner face disposed in spaced, confronting relation to one another, tightening means structured and disposed to pull said second inner face of said vertical channel towards said first inner face of said vertical channel so as to reduce a gap between said confronting faces and effectively tighten said bore about the terminal stud, said tightening means including a rotatable tightening member mounted within said clamp body, said tightening member including an upper, exteriorly engageable head portion accessible through said clamp body and adapted to facilitate the clockwise or counter-clockwise rotation thereof, an axial channel extending from at least said tightening means through said first inner face and second inner face of said vertical channel, a strong, yet flexible track extending through said axial channel, said track including a proximal end, a distal end, and a plurality of engagement apertures disposed along a length thereof, said distal end of said track being secured to said clamp body near said second inner face of said vertical channel, said tightening member including engagement means structured and disposed to engage said apertures in said track, upon rotation of said tightening member, resulting in the movement of said track and the pulling to tighten or releasing to loosen of said second inner face of said vertical channel, a longitudinal bore in said proximal portion of said clamp body, said longitudinal bore being structured and disposed to receive the battery cable therein, and fastening means structured and disposed to maintain the battery cable securely attached to said clamp body.

2. A clamp as in claim 1 wherein said tightening member includes a vertically disposed sprocket.

3. A clamp as in claim 2 wherein said engagement means on said sprocket includes a plurality of radially extending teeth extending into said axial channel.

4. A clamp as in claim 3 wherein said sprocket includes a stabilizing rim protruding from a periphery thereof, said rim being structured and disposed to be rotatable within a sized recess in said clamp body such that said sprocket will remain properly oriented and aligned during rotation.

5. A clamp as in claim 4 wherein said sprocket includes a pivot recess at a proximal end thereof, said pivot recess being structured and disposed to overlie a bearing protrusion in said clamp body such that said sprocket will rotate about said bearing protrusion.

6. A clamp as in claim 1 wherein said tightening member includes a longitudinally disposed adjustment screw.

7. A clamp as in claim 6 wherein said engagement means on said adjustment screw includes a threaded exterior surface of said adjustment screw structured and disposed to engage said apertures in said track.

8. A clamp as in claim 1 wherein said head portion of said tightening member is structured and disposed to be engaged by a screwdriver.

9. A clamp as in claim 1 wherein said head portion of said tightening is structured and disposed to be engaged by a socket wrench.

10. A clamp as in claim 1 wherein said fastening means includes a set screw adapted to pass into said longitudinal bore and engage the battery cable so as to main the battery cable within said longitudinal bore.

11. A clamp as in claim 1 wherein the battery cable is permanently secured within said longitudinal bore of said clamp body by said fastening means.

* * * * *